US005755929A

United States Patent [19]

Kuroyama et al.

[11] Patent Number: 5,755,929

[45] Date of Patent: May 26, 1998

[54] CAST-COATED PAPER FOR INK JET RECORDING AND PRODUCTION METHOD THEREOF

[75] Inventors: Yoshihiro Kuroyama; Tomonobu Ohmura; Youichi Yamazaki; Yasunori Nanri, all of Tokyo, Japan

[73] Assignee: Nippon Paper Industries, Co., Ltd., Tokyo, Japan

[21] Appl. No.: 736,666

[22] Filed: Oct. 25, 1996

[30] Foreign Application Priority Data

Oct. 26, 1995 [JP] Japan ..... 7-302108

[51] Int. Cl.[6] ..... B05D 3/12; D21F 11/06; D21H 19/80

[52] U.S. Cl. ..... 162/137; 162/135; 162/136; 428/409; 427/362

[58] Field of Search ..... 162/135–137; 428/409, 342, 511, 537.5; 427/361, 362

[56] References Cited

U.S. PATENT DOCUMENTS 4,581,257 4/1986 Kondo et al. ..... 427/336
5,281,467 1/1994 Shimada et al. ..... 428/195
5,541,002 7/1996 Hosoi et al. ..... 428/537.5

FOREIGN PATENT DOCUMENTS 0 120 095 A1 10/1984 European Pat. Off. .
0 529 308 A1 3/1993 European Pat. Off. .
7-186519 12/1993 Japan .

*Primary Examiner*—Donald E. Czaja
*Assistant Examiner*—Steven B. Leavitt
*Attorney, Agent, or Firm*—Millen, White, Zelano & Branigan, P.C.

[57] ABSTRACT

Provided are a cast-coated paper suitable for ink jet recording and a production method thereof, with the cast-coated paper having an irreversible shrinkage factor in the crossing direction within the range of 0.00% to 0.20% when it is put under an environment that the relative humidity thereof is changed from 35% to 95% and further changed to 35%.

16 Claims, No Drawings

CAST-COATED PAPER FOR INK JET RECORDING AND PRODUCTION METHOD THEREOF

FIELD OF THE INVENTION

The present invention relates to an ink jet recording paper on which images are recorded with water base ink and, more particularly, to a cast-coated paper for ink jet recording which can ensure high printing quality and gloss in recorded images and hardly causes curling and rippling problems after printing. Further, the invention is concerned with a method of producing such a cast-coated paper for ink jet recording.

BACKGROUND OF THE INVENTION

In an ink jet recording method, recording is carried out by jetting fine drops of ink using a variety of mechanisms so as to adhere to a recording paper, and thereby forming ink dots on the recording paper. Therefore, the recording method of ink jet type has advantages in that it is noiseless, can provide full-color prints with ease and enables high-speed printing, compared with the recording method of dot impact type. However, it also has a weak point in that printed ink is hard to dry since the ink used for ink jet recording is usually water based ink.

Thus, it is required of the paper used in the ink jet recording method to have properties of (1) ensuring high-speed drying of ink, (2) providing prints of high optical density, (3) inhibiting ink dots from overflowing and running, (4) not causing undulation by absorption of ink, and so on.

It has already been proposed to produce an ink jet recording paper by adopting a cast coating method, thereby answering the above-mentioned requirements to provide printed images of high quality. By using such a cast-coated paper as ink jet recording paper, the rippling trouble which has been caused in plain paper due to expansion just after printing, or the so-called cockling, can be lessened (Japanese Tokkai Sho 62-95285, wherein the term "Tokkai" as used herein means an "unexamined published patent application").

As for the cast coating method, the following three types of processes have so far been known:

(1) a direct process in which the coating in a wet condition is pressed against the hot drum having a mirror-ground surface and undergoes a drying operation, thereby copying the specular plane from the drum surface;

(2) a re-wetting process in which, after a coating is once dried, a wetting solution is applied to the dried coating to make the coating surface plastic and return it to the wet state, and then the resultant coating is pressed against the hot drum having a mirror-ground surface and undergoes a drying operation, thereby copying the specular plane from the drum surface; and (3) a coagulation process in which, immediately after a coating material is coated in a layer, the coated layer is coagulated with a coagulating solution and then pressed against the hot drum having a mirror-ground surface and undergoes a drying operation, thereby copying the specular plane from the drum surface.

That is, in producing a highly glossy cast-coated paper, the copying of a specular plane is effected in every process by drying a coating which is pressed against the hot drum having a mirror-ground surface while it is in a wet state. As for the paper therein, a paper in a wet state is dried as it is stretched on the drum. In other words, a paper undergoes tension drying under a bound condition. Therefore, the paper obtained can have excellent dimensional stability.

Due to the tension drying, however, a cast-coated paper is attended with a defect of causing curling and rippling troubles by contraction of the paper during the standing after printing.

With the intention of overcoming such a defect, the art of lessening the curling trouble after printing is disclosed in Japanese Tokkai Hei 7-25137, wherein a cast-coated paper of thick paper type, which has a basis weight of 150 to 250 g/m$^2$, is used as ink jet recording paper and the recording is carried out by making a large quantity of ink locally adhere thereto in accordance with an on-demand multi-nozzle type ink jet system.

However, thickening a recording paper as mentioned above inevitably causes a rise in price, so that such a thick recording paper is unsuitable for a wide use. Although a thin cast-coated paper is therefore preferred as ink jet recording paper, the stiffness of paper is lowered by a decrease in basis weight to enlarge ripples after printing, particularly ripples generating in the paper traveling direction in a paper machine (This direction is described for short as "machine direction", hereinafter).

Although whether such ripples appear in a non-printed area or a printed area depends on the printed pattern, they are thought to be generated in the printed pattern due to shrinkage in the direction crossing with the machine direction at right angles (This direction is described for short as "cross machine direction", hereinafter). In contrast to the curling problem, however, no effective means for solving such a rippling problem has yet been found.

SUMMARY OF THE INVENTION

As a result of our intensive studies of the aforesaid problem, it has been found that the ripples after printing can be prevented from occurring when a general base paper to which a cast coating method is applicable is once wetted, and then dried in a condition that it is not bound or almost free in the cross machine direction, and further subjected to cast coating operations, thereby achieving the present invention. As a reason why ripples of the paper after printing can be prevented, it is supposed that the drying of paper under a condition of completely or nearly no binding in the cross machine direction causes great shrinkage in the resultant paper and great elongation when the resultant paper is dipped in water, that is, deterioration of dimensional stability in the resultant paper, but on the contrary the resultant paper comes to have a negative irreversible shrinkage factor, or an elongation potentiality; as a result, the elongation property of the paper before cast coating can compensate the shrinkage property given to the paper by cast coating.

Therefore, a first object of the present invention is to provide a cast-coated paper for ink jet recording which has excellent printing characteristics and can control to the utmost the extent of ripples which generate after printing.

A second object of the present invention is to provide a method of producing a cast-coated paper for ink jet recording which has excellent printing characteristics and can control to the utmost the number and magnitude of ripples which generate after printing.

The aforementioned objects are attained by a cast-coated paper for ink jet recording which has on at least one side of a base paper a recording layer formed by a cast coating method, with the cast-coated paper having an irreversible shrinkage factor in the cross machine direction within the range of 0.00% to 0.20% when it is put under an environment that the relative humidity thereof is changed from 35% to 95% and further changed to 35%; and by a method of producing the above-defined cast-coated paper.

DETAILED DESCRIPTION OF THE INVENTION

The base paper used for the present cast-coated paper has no particular restrictions, excepting its irreversible shrinkage factor in the cross machine direction. The pulp used therein can be selected properly from those generally used in paper making, such as hardwood- or softwood-made chemical pulp, mechanical pulp and deinked pulp. Such a base paper can contain an internal filler. Such a filler can be selected properly from generally used ones, e.g., talc, kaolin, calcium carbonate, titanium dioxide and so on.

As for the irreversible shrinkage factor in the cross machine direction, it is preferable for the base paper used in the present invention to have that factor in the range of −0.60% to −0.20%, particularly −0.10% to −0.15%, when the base paper is put under an environment that the relative humidity thereof is changed from 35% to 90% and further changed to 35%.

As for the base paper before cast coating, a base paper wetted by applying thereto a water-base coating material or water alone and then dried under a condition of completely or nearly no binding in the cross machine direction may be previously prepared for the present invention, or just before cast coating a base paper may undergo a wetting treatment with a coater and a subsequent drying treatment under the condition mentioned above. The wetting treatment may be carried out by a re-wetting treatment or by forming an undercoat. A coating material for the undercoat may be a water base coating color, e.g., containing a water-soluble or water-dispersible polymer and/or pigments. As for the coating color containing pigments, one or more kinds of pigments are mixed with a water-soluble or water-dispersible polymer, admixed with an auxiliary agent, if needed, and then made into the so-called coating color.

As for the water-soluble or water-dispersible polymer, starch, polyvinyl alcohol, carboxymethyl cellulose, casein, styrene/butadiene latex, acrylic emulsion and vinyl acetate emulsion are examples thereof. As for the pigment, clay, calcium carbonate, titanium oxide, silica and organic pigments are examples thereof.

The method for coating of a water base coating color can be properly selected from the coating methods using known coating machines, such as a blade coater, an air knife coater, a roll coater, a kiss coater, a squeegee coater, a curtain coater, a bar coater, a gravure coater and a comma coater.

As for the drying after coating under a condition of completely or nearly no binding in the cross machine direction, the drying can be effected by exposing both sides of a wet paper to heat with a usual hot-air dryer, an infrared dryer or a SCAF (which stands for "Sine Curve Air Floating") dryer while the paper is tensed in the machine direction alone without being bound in the cross machine direction.

On the other hand, in a case where a cylinder dryer is used in order to secure dimensional stability and inhibit curling in the process of making a base paper, the base paper is dried in a bound condition. As a result, the base paper obtained therein has an irreversible shrinkage factor in the cross machine direction in the range of 0.00 to 0.10 when the relative humidity of the environment in which the base paper is put is changed from 35% to 95% and further changed to 35%. If such a base paper is subjected to cast coating and dried under a pressed condition, the irreversible shrinkage factor thereof rather increases. Therefore, the base paper used in the present invention is required to avoid drying with a multi-cylinder dryer.

Examples of a pigment which can be used in the recording layer of the present ink jet recording paper include amorphous silica, kaolin, calcium carbonate,, alumina, aluminum hydroxide, magnesium carbonate, satin white, ammonium silicate, colloidal silica and montmorillonite. Also, these pigments can be used as a mixture of two or more thereof.

Suitable examples of a binder which can be used in the recording layer include casein, soybean protein, starch, polyvinyl alcohol, carboxymethyl cellulose, a styrene-butadiene latex, an acrylic emulsion, a vinyl acetate emulsion and polyurethane. These binders can be used alone or as a mixture of two or more thereof.

To a coating material for the recording layer, various auxiliary agents used for conventional coating materials, such as a dispersing agent, a flowability modifier, a defoaming agent, a dye, a lubricant and a water-holding agent, can further be added.

In coating a coating material for the recording layer, the method therefor can be selected properly from the coating methods using conventional coating machines as recited above with respect to the formation of an undercoat.

The coverage rate of the recording layer can be adjusted arbitrarily as far as it is enough to cover the whole surface of a base paper and ensure sufficient ink absorption. However, it is desirable that the coverage rate of the recording layer be from 5 to 30 g/m$^2$ per sides particularly from 10 to 25 g/m$^2$ per side, on a solids basis.

In a special case where the cast coating is carried out in accordance with a coagulation process, a coagulant is used. Specific examples of a coagulant generally used therein include various salts formed from metals, such as calcium, zinc, barium, lead, magnesium, cadmium and aluminum, and acids, such as formic acid, acetic acid, citric acid, tartaric acid, lactic acid, hydrochloric acid and sulfuric acid; potassium sulfate; potassium citrate; borax; and boric acid.

Since the base paper as one constituent of the present ink jet recording paper is at least once wetted and dried in the condition of completely or nearly no binding in the cross machine direction prior to the drying in accordance with a cast coating method wherein the drying is carried out in a bound condition in the cross machine direction also, the resultant cast-coated paper for ink jet recording can be reduced in the irreversible shrinkage factor in the cross machine direction, thereby inhibiting ripples from generating after printing.

The expression "drying in a bound condition" as used herein is intended to include the drying method in which a wet coating is dried by being pressed against the hot drum having a mirror-ground surface as in a cast coating method, the drying method using a Yankee dryer which is similar to the above method, and the drying method using a cylinder dryer wherein the paper is bound on both sides.

Additionally, the hot drum having a mirror-ground surface used in the present invention signifies a drum heated at around 100° C. and having a mirror-ground cylindrical external surface.

The present cast-coated paper thus obtained has high gloss and can provide good quality of printing when subjected to ink jet recording. Moreover, the present cast-coated paper has an advantage in that it hardly generates curling and ripples after printing.

In other words, the cast-coated paper produced in accordance with the present invention has high gloss, high printing quality, and diminished curling and ripples after printing, so that it is suitable for use as the paper for color ink jet recording.

The present invention has a considerable significance in the art. The present cast-coated paper for ink jet recording has not only high printing quality and high gloss, but also controls to the utmost the generation of curling and ripples after printing. Further, in the production thereof, conventional apparatus and arts for production of cast-coated paper for ink jet recording can be utilized as they are.

The present invention will now be illustrated in more detail by reference to the following examples. However, the invention should not be construed as being limited to these examples. Unless otherwise noted, all "%" and all "parts" in the examples are by weight.

EXAMPLE 1

Preparation of Coating Material for Recording Layer:

A water-base coating material having a solids concentration of 30% was prepared. Therein, the solids were constituted of, as pigments, 80 parts of synthetic silica (Mizukasil P-78F, trade name, a product of Mizusawa Industrial Chemicals, Ltd.) and 20 parts of precipitated calcium carbonate (Tamapearl 121, trade name, a product of Okutama Kogyo Co., Ltd.), as binders, 30 parts of casein (Lactic Casein, made in New Zealand) and 20 parts of polyvinyl alcohol (PVA 117, trade name, a product of Kuraray Co., Ltd.) and, as a mold lubricant, 3 parts of calcium stearate (Nopcoat C-104, a trade name, a product of San Nopco Ltd.).

Preparation of Coagulating Solution:

A coagulating solution was prepared, in which 10% of calcium formate as a coagulant and 3% of polyethyleneimine quaternary ammonium salt were contained.

Preparation of Coating Material for Undercoat:

A water-base coating material having a solids concentration of 45% was prepared for an undercoat. Therein, the solids were constituted of a mixture of 90 parts of Kaoline (UW-90, trade name, a product of Engelhard M & C Co.) with 10 parts of precipitated calcium carbonate (Tamapearl 121, trade name, a product of Okutama Kogyo Co., Ltd.) as pigment, and 15 parts of styrene-butadiene latex (SN307, trade name, a product of Sumitomo Naugatuc Co., Ltd.) as binder.

A paper stock containing as solids components 83 parts of LBKP with a Canadian standard freeness of 310 ml, 17 parts of precipitated calcium carbonate, 0.05 part of a sizing agent (alkylketene dimer), 1.0 part cationized starch, 0.2 part of paper strength reinforcing agent and 0.02 part of a retention aid was adjusted to a concentration of 0.03%, and therefrom a raw paper was made by means of a Fourdrinier machine of multi-cylinder type. On the raw paper thus obtained, starch was coated at a dry coverage of 2 g/m$^2$ by means of a size press to prepare a woodfree paper having a basis weight of 110 g/m$^2$. The irreversible shrinkage factor of this woodfree paper was 0.08%.

Further, both sides of the woodfree paper were coated successively with the coating material prepared above for an undercoat by means of a roll coater at a per side coverage of 10 g/m$^2$ on a solids basis, and then dried with a hot-air dryer. The thus obtained base paper had an irreversible shrinkage factor of −0.12%.

Furthermore, one side of the base paper was coated with the coating material prepared above for a recording layer by means of a roll coater at a dry coverage of 14 g/m$^2$, followed by coating with the coagulation solution prepared above by means of a roll coater. Thereafter, the coated surface was pressed against a cast drum heated at 100° C. while it was in a wet condition, and then dried. The thus obtained cast-coated paper for ink jet recording had an irreversible shrinkage factor of 0.09%.

Additionally, the foregoing irreversible shrinkage factors were determined by the method described below, and the quality of the cast-coated paper obtained was evaluated by the following method.

The results obtained are shown in Table 1.

Determination of Irreversible Shrinkage Factor:

A paper sample was placed in an environmental test room wherein the temperature and the humidity can be controlled, and the humidity in the room was changed continuously in this order, 50% RH→35% RH→90% RH→35% RH, while the temperature is kept at 25° C. The resultant paper sample was examined for the length thereof and the water content therein by means of an extensometer having a water-content measurement function also. Additionally, the time of one cycle (35% RH→90% RH→35% RH) was adjusted to 6 hours. Therein, the irreversible shrinkage factor (%) of the paper was defined as $[(L_1-L_2)/L_0]\times 100$, wherein $L_0$ represents the length of the paper having a water content of $M_0$ under the humidity set at the initial stage (50% RH), $L_1$ represents the length which the paper has at the time when, during the process of moisturization (humidity change; 35% RH→90% RH), the water content in the paper comes to $M_0$ at the humidity of 50% RH, and $L_2$ represents the length which the paper has at the time when, during the process of demoisturization (humidity change; 90% RH→35% RH), the water content in the paper comes to $M_0$ at the humidity of 50%.

In addition, all the irreversible shrinkage factors set forth below are those in the cross machine direction.

Evaluation Method of Ripples:

Printing was carried out on a cast-coated paper sample so that a monochromatic solid area alternated with a blank area by the use of a color ink jet printer (BJC-400 J, trade name, a product of Canon Inc.), and dried spontaneously. The extent of ripples generated in the resultant sample was evaluated in three grades, ⊙, ○ and X, by visual observation. The grades, ⊙ and ○, indicate that the extent of ripples is negligibly small.

EXAMPLE 2

A woodfree paper having an irreversible shrinkage factor of 0.03% was prepared in the same manner as in Example 1, except that LBKP with a Canadian standard freeness of 450 ml was used in place of the LBKP with a Canadian standard freeness of 310 ml.

One side of the woodfree paper thus obtained was coated with water by means of a bar coater, and dried with a hot-air dryer to prepare a base paper. The irreversible shrinkage factor of the base paper was −0.05%.

On the side to which water was not applied, the base paper was coated with the coating material prepared above for a recording layer by means of a roll coater at a dry coverage of 12 g/m$^2$, followed by coating with the coagulation solution prepared above by means of a roll coater. Thereafter, the coated surface was pressed against a cast drum heated at 100° C. while it was in a wet condition, and then dried. The thus obtained cast-coated paper for ink jet recording had an irreversible shrinkage factor of 0.18%. The evaluation result of this cast-coated paper is also shown in Table 1.

EXAMPLE 3

One side of the same woodfree paper as prepared in Example 1 was coated with a 1% water solution of polyvinyl alcohol by means of a bar coater so that the polyvinyl alcohol had a coverage of 0.2 g/m$^2$, and dried with a hot-air dryer. The irreversible shrinkage factor of the coated paper thus obtained was −0.03%.

On the side to which the polyvinyl alcohol was not applied, the base paper was coated with the coating material prepared above for a recording layer by means of a roll coater at a dry coverage of 16 g/m$^2$, followed by coating with the coagulation solution prepared above by means of a roll coater. Thereafter, the coated surface was pressed against a cast drum heated at 100° C. while it was in a wet condition, and then dried. The thus obtained cast-coated paper for ink jet recording had an irreversible shrinkage factor of 0.15%. The evaluation result of this cast-coated paper is also shown in Table 1.

EXAMPLE 4

Both sides of the same woodfree paper as prepared in Example 2 were coated with water by means of a bar coater, and dried with a hot-air dryer. The irreversible shrinkage factor of the thus treated paper was −0.15%.

One side of the treated paper was coated with the coating material prepared above for a recording layer by means of a roll coater at a dry coverage of 13 g/m$^2$, followed by coating with the coagulation solution prepared above by means of a roll coater. Thereafter, the coated surface was pressed against a cast drum heated at 100° C. while it was in a wet condition, and then dried. The thus obtained cast-coated paper for ink jet recording had an irreversible shrinkage factor of 0.03%. The evaluation result of this cast-coated paper is also shown in Table 1.

COMPARATIVE EXAMPLE 1

A cast-coated paper for ink jet recording was prepared in the same manner as in Example 1, except that no undercoat was provided. The cast-coated paper thus obtained had an irreversible shrinkage factor of 0.28%. The evaluation result of this cast-coated paper is also shown in Table 1.

COMPARATIVE EXAMPLE 2

A cast-coated paper for ink jet recording was prepared in the same manner as in Example 2, except that water was not applied to the woodfree paper. The cast-coated paper thus obtained had an irreversible shrinkage factor of 0.26%. The evaluation result of this cast-coated paper is also shown in Table 1.

TABLE 1

| | Irrevesible Shrinkage factor (%) before treatment | Treatment | Irrevesible Shrinkage factor (%) after treatment | Irrevesible Shrinkage factor (%) of cast-coated paper | Extent of ripple Generation |
|---|---|---|---|---|---|
| Example 1 | 0.08 | Double-sided coating with pigment | −0.12 | 0.09 | ◎ |
| Example 2 | 0.03 | Single-sided coating with water | −0.05 | 0.18 | ○ |
| Example 3 | 0.08 | Single-sided coating with resin | −0.03 | 0.15 | ○ |
| Example 4 | 0.03 | Double-sided coating with water | −0.15 | 0.03 | ◎ |
| Comparative Example 1 | 0.08 | no treatment | — | 0.28 | X |
| Comparative Example 2 | 0.03 | no treatment | — | 0.26 | X |

What is claimed is:

1. A cast-coated paper for ink jet recording which has on at least one side of a base paper a recording layer formed by a cast coating method, said cast-coated paper having an irreversible shrinkage factor in the cross machine direction within the range of 0.00% to 0.20% when it is put under an environment that the relative humidity thereof is changed back from 35% to 95% and further changed to 35%.

2. A cast-coated paper for ink jet recording as described in claim 1, wherein said base paper is a base paper which has undergone at least one-time wetting treatment and a subsequent treatment of drying under a condition of completely or nearly no binding in the cross machine direction.

3. A cast-coated paper for ink jet recording as described in claim 2, wherein said wetting treatment comprises coating a base paper with water alone or a water-base coating material.

4. A cast-coated paper for ink jet recording as described in claim 3, wherein said water-base coating material comprises a pigment, a water-soluble or water-dispersible polymer, or a mixture thereof.

5. The cast-coated paper of claim 4, wherein the water-base coating material comprises a pigment containing clay, calcium carbonate, titanium oxide, silica or an organic pigment.

6. The cast-coated paper of claim 4, wherein the water-base coating material comprises starch, polyvinyl alcohol, carboxymethyl cellulose, casein, styrene/butadiene latex, an acrylic emulsion or a vinyl acetate emulsion as water-soluble or water-dispersible polymer.

7. A cast-coated paper for ink jet recording as described in claim 2, wherein said drying treatment is carried out by exposing both sides of a wetted base paper to heat with a hot-air dryer, an infrared dryer or a SCAF dryer while the base paper is tensed in the machine direction alone without being bound in the cross machine direction.

8. The cast-coated paper of claim 2, wherein the wetting treatment of the base paper is conducted by forming an undercoat with a water-base coating material.

9. A cast-coated paper for ink jet recording as described in claim 1, wherein said base paper, before being cast-coated, has an irreversible shrinkage factor ranging from −0.00% to −0.20% in the cross machine direction when the base paper is put under an environment that the relative humidity thereof is changed from 35% to 90% and further changed back to 35%.

10. A cast-coated paper for ink jet recording as described in claim 9, wherein the irreversible shrinkage factor of the base paper in the cross machine direction is from −0.10% to −0.15%.

11. The cast-coated paper of claim 1, wherein the base paper contains a talc, kaolin, calcium carbonate or titanium dioxide filler.

12. The cast-coated paper of claim 1, wherein the recording layer comprises a pigment of amorphous silica, kaolin, calcium carbonate, alumina, aluminum hydroxide, magnesium carbonate, satin white, ammonium silicate, colloidal silica, montmorillonite or mixtures thereof and a binder of casein, soybean protein, starch, polyvinyl alcohol, carboxymethyl cellulose, styrene-butadiene latex, an acrylic emulsion, a vinyl acetate emulsion, polyurethane or mixtures thereof.

13. The cast-coated paper of claim 1, wherein the recording layer has a coverage rate of 5 to 30 $g/m^2$ per side.

14. A method of producing a cast-coated paper for ink jet recording, comprising coating a base paper with water or a water-base coating material to wet the base paper, drying the wetted base paper under a condition of completely or nearly no binding in the cross machine direction and subsequently providing a recording layer on at least one side of the dried base paper by a cast coating method.

15. The method of claim 14, wherein the base paper is coated with a water-base coating material and the water-base coating material comprises a pigment containing clay, calcium carbonate, titanium oxide, silica or an organic pigment.

16. The method of claim 14, wherein the base paper is coated with a water-base coating material and the water-base coating material comprises starch, polyvinyl alcohol, carboxymethyl cellulose, casein, styrene/butadiene latex, an acrylic emulsion or a vinyl acetate emulsion as water-soluble or water-dispersible polymer.

* * * * *